US005764011A

United States Patent [19]

Nakae et al.

[11] Patent Number: 5,764,011

[45] Date of Patent: Jun. 9, 1998

[54] AIR CONDITIONER

[75] Inventors: Tsugio Nakae, Gunma; Tomonori Isobe; Hajime Takada, both of Kumagaya, all of Japan

[73] Assignee: Sanyo Electric Co., Ltd., Osaka, Japan

[21] Appl. No.: 735,087

[22] Filed: Oct. 22, 1996

[30] Foreign Application Priority Data

Oct. 23, 1995 [JP] Japan ..... 7-274223

[51] Int. Cl.[6] ..... H02P 5/28; F24F 1/00

[52] U.S. Cl. ..... 318/471; 318/806; 318/807; 318/434; 62/228.4; 62/229

[58] Field of Search ..... 318/800–808, 318/450–490, 384–90, 500–580; 62/211, 223, 228.4, 89, 186, 230, 129, 158, 160, 180, 213, 229, 209, 215; 236/78 D; 361/22–32; 388/934, 811, 814

[56] References Cited

U.S. PATENT DOCUMENTS

| | | | |
|---|---|---|---|
| 4,408,244 | 10/1983 | Weible | 361/24 |
| 4,667,480 | 5/1987 | Bessler | 62/180 |
| 4,736,595 | 4/1988 | Kato | 62/160 |
| 4,738,118 | 4/1988 | Kanazawa | 62/215 |
| 4,831,836 | 5/1989 | Matsuoka | 62/209 |
| 5,095,715 | 3/1992 | Dudley | 62/228.4 |
| 5,123,080 | 6/1992 | Gillett et al. | 388/934 |
| 5,263,335 | 11/1993 | Isono et al. | 62/228.4 |
| 5,299,430 | 4/1994 | Tsuchiyama | 62/180 |
| 5,372,015 | 12/1994 | Suzuki et al. | 62/228.4 |
| 5,493,868 | 2/1996 | Kikuiri et al. | 62/129 |
| 5,502,976 | 4/1996 | Otori et al. | 62/129 |
| 5,568,733 | 10/1996 | Toyota et al. | 62/228.4 |
| 5,613,369 | 3/1997 | Sato et al. | 62/89 |
| 5,628,201 | 5/1997 | Bahel et al. | 62/211 |

FOREIGN PATENT DOCUMENTS

| | | | |
|---|---|---|---|
| 0588633 | 3/1994 | European Pat. Off. | G05D 23/24 |
| 2-5981 | 2/1985 | Japan . | |
| 5015185 | 1/1993 | Japan | H02P 5/00 |
| 52-03234 | 8/1993 | Japan | F24F 11/02 |
| 62-33589 | 8/1994 | Japan | H02P 7/63 |
| 7266852 | 10/1995 | Japan | B60H 1/32 |

*Primary Examiner*—Paul Ip
*Attorney, Agent, or Firm*—Darby & Darby

[57] ABSTRACT

An air conditioner which has a controller equipped with heat-producing electrical parts and in which the driving current of a compressor, etc., is controlled by the controller, includes a temperature sensor which is provided to or in the vicinity of at least one heat-sensitive electrical part (for example, a power transistor) of the electrical parts and adapted to detect the temperature of a heat-sensitive electrical part, and means for stepwise or linearly reducing the upper-limit value of the driving current of the compressor in accordance with the increase of the detected temperature when the temperature detected by the temperature sensor is higher than a predetermined value.

14 Claims, 6 Drawing Sheets

AIR CONDITIONER

BACKGROUND OF THE INVENTION

1. Field of the Invention

The present invention relates to an air conditioner having controller equipped with electrical parts such as a power transistor, etc., the controller controlling a driving current of a compressor, etc.

2. Description of Related Art

A so-called inverter type air conditioner in which the rotational speed of a compressor is variable in accordance with an air-conditioning load so as to vary the power of the compressor, has been known, as disclosed in Japanese Post-examined Patent Application (KokoKu) No. Hei-2-5981. A controller used in this type of air conditioner is generally equipped with a power transistor as an electrical part for control.

In some air conditioners of the above type, when cooling operation is carried out under an overload, in general the upper-limit value of the driving current of the compressor is suddenly reduced to a predetermined fixed value or less on the basis of the detected temperature of a detector for detecting the outside air temperature to protect the electrical parts such as the power transistor, etc., from heat. Further, in other air conditioners, a thermostat is mounted on a heat sink for cooling the power transistor, and the driving of the compressor is stopped when the thermostat detects a predetermined temperature. having the outside temperature detector, the control mode for the protection of the electrical parts is greatly varied between a situation where an outdoor unit having an outside air temperature detector is located under a sunny condition and a situation where it is located under an unsunny or shady condition. Particularly when the outdoor unit is located under the sunny condition, an indoor unit is often located in a room-having a sunny aspect. In this case, the cooling operation trends to be more frequently carried out as compared with such a situation that the indoor unit is located in a room with an unsunny aspect. Therefore, for example, in such a severely hot condition that the outside air temperature is very high, the reduction of the driving current of the compressor by the protection control and the stop control of the driving operation are more frequently performed. Therefore, it is very difficult to protect the power relay in accordance with the outside air temperature.

Further, with respect to the air conditioners each using the thermostat, when the air-conditioning load is large, the stop control of the driving of the compressor trends to be more frequently performed by the protection control. This situation occurs in a case where the cooling operation is particularly required by a user. Therefore, the control of stopping the driving of the compressor greatly disturbs the user, who is prevented from enjoying a comfortable air-conditioning atmosphere, and it would be preferable to continue the driving of the compressor although the driving power of the compressor is a little lowered.

SUMMARY OF THE INVENTION

An object of the present invention is to provide an air conditioner which is enabled to be continuously operated even when the driving operation thereof is carried out under an overload.

In order to attain the above object, according to the present invention, there is provided an air conditioner which has a controller equipped with heat-producing electrical parts and in which the driving current of a compressor, etc., is controlled by the controller, which includes a temperature sensor which is provided to or in the vicinity of at least one heat-sensitive electrical part of the electrical parts and adapted to detect the temperature of the heat-sensitive electrical part, and means for gradually reducing the upper-limit value of the driving current of the compressor when the temperature detected by the temperature sensor is higher than a predetermined value.

In the air conditioner as described above, the controller is equipped with a power transistor, and a temperature sensor is provided to the transistor or in the vicinity of the transistor. When the temperature detected by the temperature sensor is higher than the predetermined value, the means reduces the upper-limit value of the driving current of the compressor.

In the air conditioner as described above, the means reduces the upper-limit value of the driving current of the compressor stepwise or linearly in accordance with an increase of the temperature detected by the temperature sensor.

DETAILED DESCRIPTION OF THE PREFERRED EMBODIMENT

A preferred embodiment according to the present invention will be described hereunder with reference to the accompanying drawing.

Figure 1:
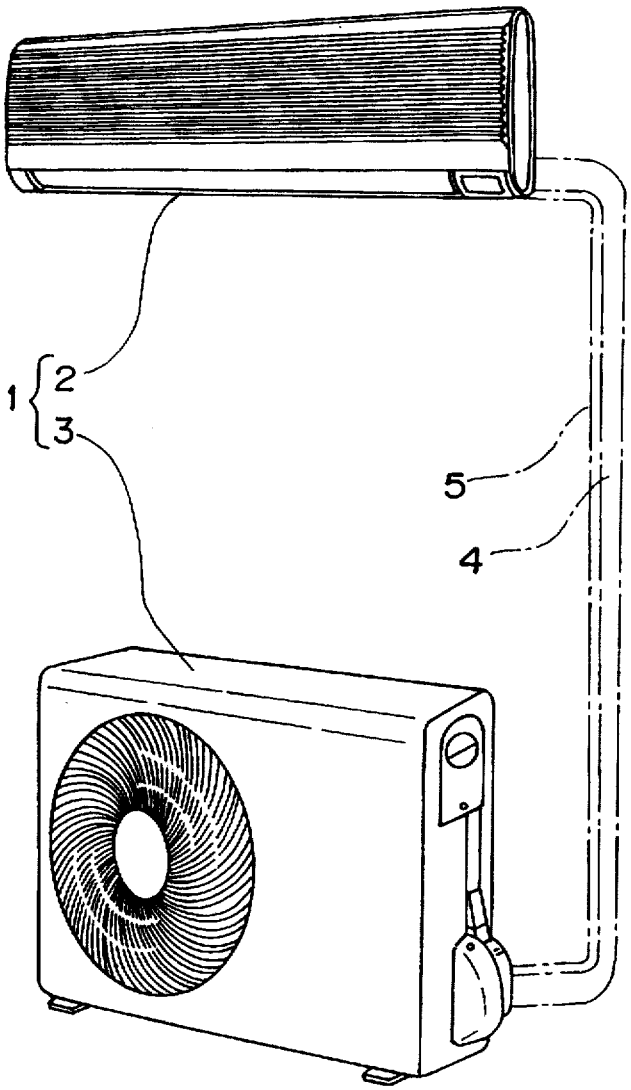
FIG. 1 is an outline of an air conditioner according to the present invention.

FIG. 1 is a diagram showing the outlook of the air conditioner 1, and the outline of FIG. 1 is different from the actual arrangement of the air conditioner because both the front face sides of the outdoor and indoor units of the air conditioner are illustrated as being faced to the same direction.

The air conditioner 1 shown in FIG. 1 is mainly constructed of an indoor unit 2 and an outdoor unit 3, and both the units are connected to each other through an interunit pipe 4 and an interunit cable 5.

Figure 2:
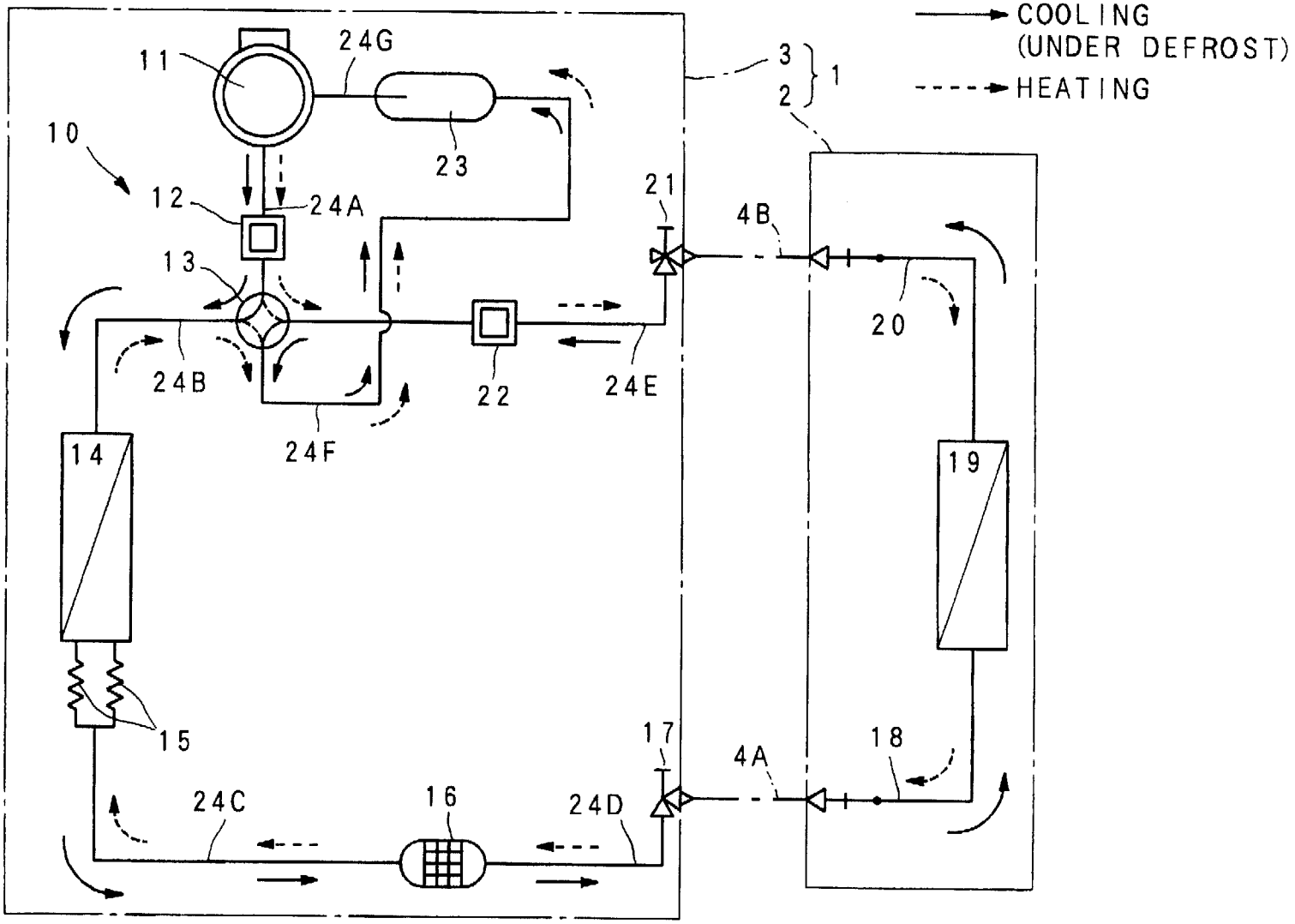
FIG. 2 is a diagram showing a refrigerant circuit of the air conditioner shown in FIG. 1.

In FIG. 2, reference numeral 10 represents a refrigerant circuit of the air conditioner 1, reference numeral 11 represents a compressor for compressing the refrigerant, reference numeral 12 represents a muffler, reference numeral 13 represents a four-way valve for changing the direction of the refrigerant flow, reference numeral 14 represents an outdoor heat exchanger, reference numeral 15 represents an expansion device (pressure-reducing device) using capillary tubes, reference numeral 16 represents a strainer for removing impurities from the refrigerant, reference numeral 17 represents a service valve, reference numeral 4A represents an interunit pipe, reference numeral 18 represents an auxiliary pipe, reference numeral 19 represents an indoor heat exchanger, reference numeral 20 represents an auxiliary pipe, reference numeral 4B represents an interunit pipe, reference 21 represents a service valve, reference numeral 22 represents a muffler, reference numeral 23 represents an accumulator, and reference numerals 24A to 24G represent refrigerant pipes for connecting the respective equipments as described above.

In FIG. 2, an arrow indicated by a solid line represents the refrigerant flow in cooling operation (under defrosting operation) and an arrow indicated by a dotted line represents the refrigerant flow in heating operation. The cooling and heating operation of the air conditioner is substantially similar to that of the conventional air conditioner, and thus the detailed description thereof is omitted from the specification.

Figure 3:
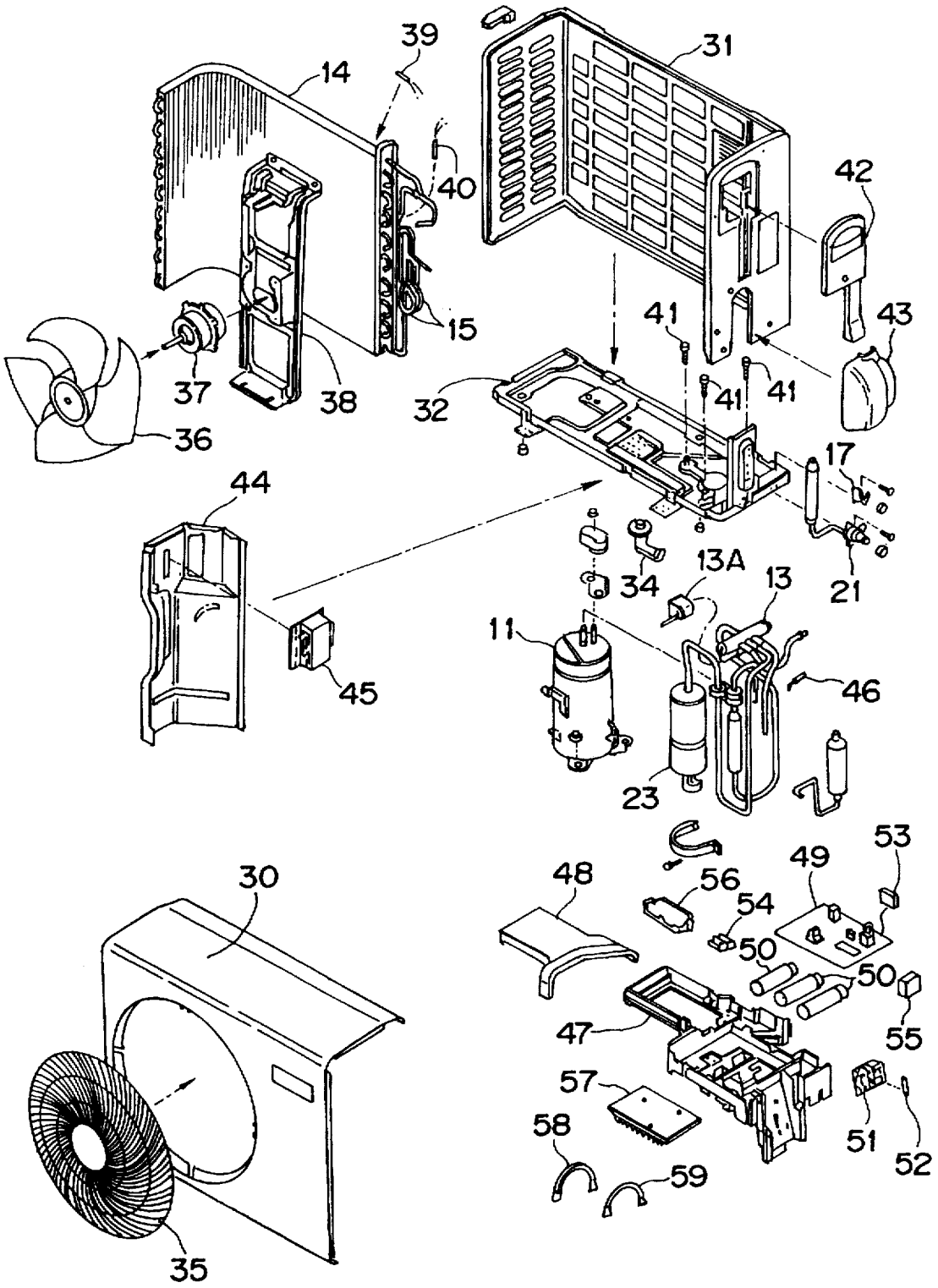
FIG. 3 is an exploded view showing an outdoor unit of the air conditioner shown in FIG. 1.

FIG. 3 is an exploded view showing an outdoor unit of the air conditioner shown in FIG. 1.

In FIG. 3, reference numeral 30 represents a panel comprising a top plate and a front plate which are integrally formed with each other, reference numeral 31 represents a panel comprising both side plates and a back plate which are integrally formed with each other, and reference numeral 32 represents a bottom plate. The panel 30, the panel 31 and the bottom plate 32 constitute an outer case 33. Reference numeral 34 represents a drain pipe, and reference numeral 35 represents a fan guard.

Reference numeral 36 represents a propeller fan, reference numeral 37 represents a fan motor for driving the fan 36, reference numeral 38 represents a motor stand for supporting the motor 37, reference numeral 39 represents an outside air temperature detector (sensor) for detecting the outside air temperature, reference numeral 40 represents an outdoor heat exchanger detector (sensor) for detecting the temperature of the outdoor heat exchanger, reference numeral 41 represents a vibration preventing rubber member for suppressing the vibration of the compressor, reference numeral 42 represents a cover for covering a terminal stand and wires, reference numeral 43 represents a valve cover, reference numeral 44 represents a partition plate for partitioning a heat exchanger chamber and a mechanical chamber from each other, reference numeral 45 represents a reactor mounted to the partition plate 44, reference numeral 13A represents an electromagnetic coil for driving a needle of the four-way valve 13, reference numeral 46 represents a detector for detecting the temperature of the refrigerant, reference numeral 47 represents an electrical equipment box, reference numeral 48 represents a cover for the electrical equipment box, reference numeral 49 represents a control board, reference numeral 50 represents electrolytic capacitors, reference numeral 51 represents a terminal board, reference numeral 52 represents a fuse, reference numerals 53 and 54 represent integrated circuits (Ics), reference numeral 55 represents a capacitor, reference numeral 56 represents an HIC (hybrid IC) having a power transistor and a driving circuit for driving the power transistor, reference numeral 57 represents a cooler to which the HIC is secured, and reference numerals 58 and 59 represent lead wires for connecting electrical parts to one another.

Figure 4:
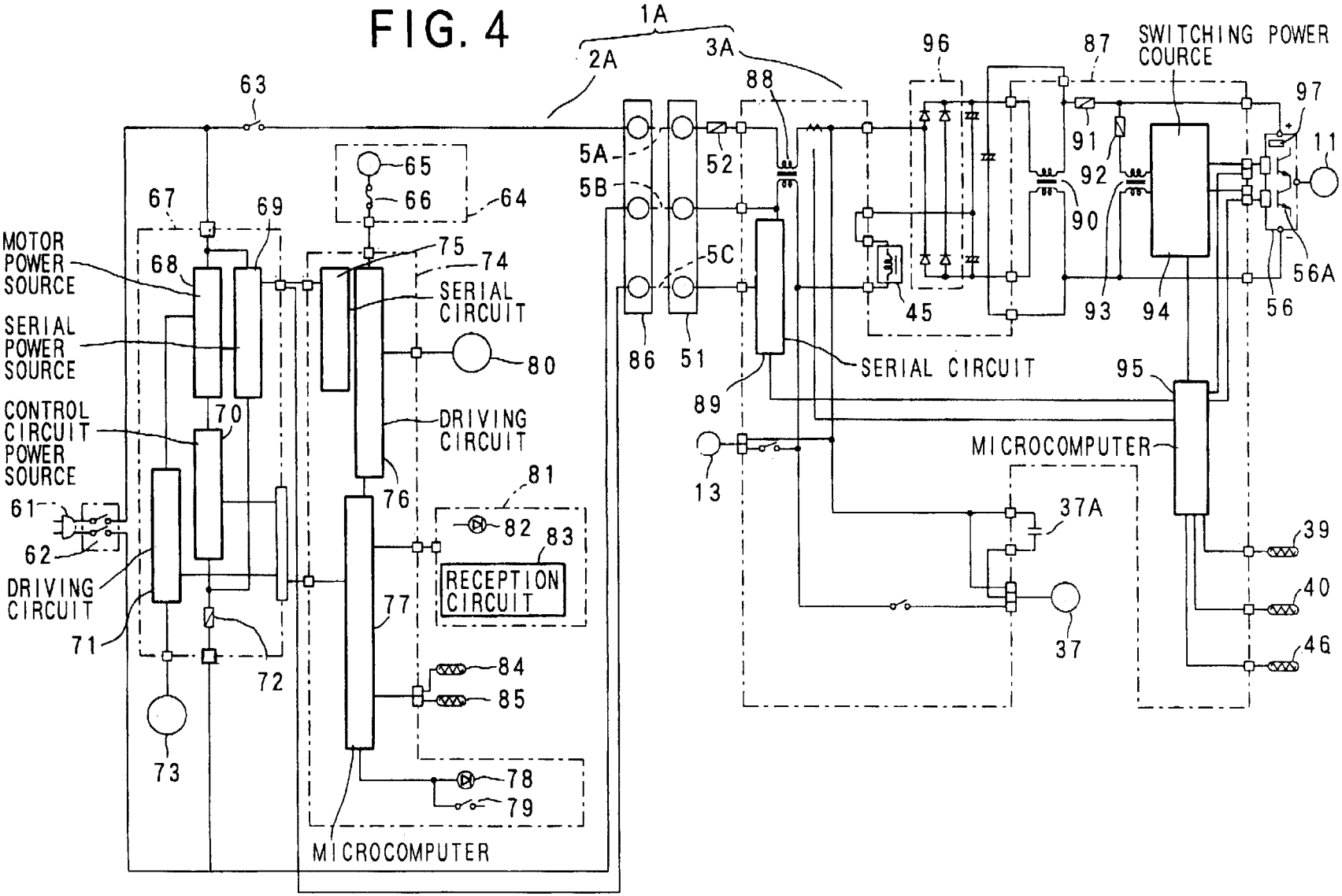
FIG. 4 is an electrical circuit diagram showing a controller for the air conditioner shown in FIG. 1.

FIG. 4 shows an electrical circuit diagram 1A of the air conditioner, and it mainly comprises an electrical circuit 2A at the indoor unit side and an electrical circuit 3A at the outdoor unit side.

Reference numeral 61 represents a plug for supplying power to the controller of the indoor unit, reference numeral 62 represents a switch for the power source, reference numeral 63 represents a power relay, and reference numeral 64 represents a power relay board. A power relay 65 and a fuse 66 are provided on the power relay board 64. Reference numeral 67 represents a power source board, reference numeral 68 represents a power source for the motor, reference numeral 69 represents a serial power source, reference numeral 70 represents a power source for a control circuit, reference numeral 71 represents a driving circuit, reference numeral 72 represents a fuse, reference numeral 73 represents a fan motor, reference numeral 74 represents a control board, reference numeral 75 represents a serial circuit, reference numeral 76 represents a driving circuit, reference numeral 77 represents a microcomputer (which is abbreviated as "micron"), reference numeral 78 represents a service LED (light emitting diode) used for service, reference numeral 79 represents a driving change-over switch, reference numeral 80 represents an up-and-down flap motor for driving an up-and-down flap (an air blow direction changing plate which is located to extend in a lateral direction and adapted to change the direction of the air flow (upward and downward directions)), and reference numeral 81 represents a display board which has a display LED 82 and a reception circuit 83 for receiving a signal from a wireless remote controller. Reference numeral 84 represents a room temperature sensor for detecting the temperature of the room air, reference numeral 85 represents a heat exchange temperature sensor for detecting the temperature of the indoor heat exchanger, reference numeral 86 represents a 3-pin terminal board at the indoor unit side, and reference numerals 5A,5B, and 5C represent interunit cables.

Reference numeral 87 represents a control board, reference numeral 88 represents a noise filter, reference numeral 89 represents a serial circuit, reference numeral 90 represents a noise filter, reference numeral 91 represents a fuse, reference numeral 92 represents a fuse, reference numeral 93 represents a noise filter, reference numeral 94 represents a switching power source, and reference numeral 95 represents a microcomputer. Reference numeral 96 represents a diode, and reference numeral 56A represents a power transistor which is provided in the HIC. The power transistor is connected to a drive circuit (not shown) for driving the transistor. Reference numeral 97 represents a temperature sensing element (temperature sensor) which is provided to the power transistor to detect the temperature of the power transistor. The temperature sensing element (temperature sensor) 97 is formed of a thermistor and serves to output a signal representing the detected temperature to the microcomputer 95. Reference numeral 37A represents a capacitor for the fan motor.

The driving current of the compressor can be controlled by adjusting the driving frequency of the compressor under control of the control board. Accordingly, not only the driving power of the compressor can be varied, but also the driving current of the compressor can be varied under control of the control board (controller).

The operation of the air conditioner thus constructed will be next described.

During the operation of the air conditioner, the microcomputer receives signals from various sensors, and controls the driving frequency of the compressor to control the driving (rotational speed) of the compressor. When a large cooling load is required in cooling operation, for example, when many persons gather in a room which is to be air-conditioned or when a low temperature value is set, the driving of the compressor is carried out at a driving level which is relatively near to the maximum level. In such a case, the temperature of the HIC is liable to rises up to a relatively high temperature. In normal practical use, the temperature of the HIC is required to be set to 70° C. or less. However, when the outside air temperature is extremely high or when the outdoor unit is located under a sunny condition, the temperature and the pressure in the refrigerant circuit are increased, and the temperature of the HIC is also increased. In this case, a protection circuit is actuated to stop the driving of the air conditioner. When the driving of the air conditioner is stopped by the protection circuit in the above situation, some users may feel uncomfortable due to the loss of air conditioning. Accordingly, according to the present invention, the driving of the air conditioner is controlled to be carried out as continuously as possible even if the driving power (cooling power) thereof is lowered.

Specifically, the driving of the compressor under such a situation is carried out as follows. It is assumed that the upper limit value of the driving current of the compressor is normally set to 15A. In this case, if the temperature detected by the temperature sensor is equal to a predetermined value (for example, :80° C.), the driving frequency is controlled so that the upper limit value of the driving current of the compressor is reduced by 0.5A and thus it is set to 14.5A, for example. Therefore, the maximum value (upper limit value) of the cooling power is reduced. Nonetheless, the cooling operation continues, and the cooling operation avoids being suddenly stopped. Furthermore, when the detected temperature rises to 81° C., the upper limit value is further reduced by 0.5A, and thus the driving current is set to 14.0A, for example. Likewise, when the temperature successively rises up to 82° C., 83° C., 84° C., 85° C., 86° C., 87° C., 88° C., or 89° C., the upper limit value of the cooling operation is further successively reduced by every 0.5A and set to 13.5A, 13.0A, 12.5A, 12.0A,11.5A, 11.0A, 10.5A, 10.0A respectively. When the detected temperature further rises up to 100° C., the driving of the air conditioner is finally stopped to prevent the power transistor from being damaged (see FIG. 5). In this embodiment, the predetermined value is set in the range of 80° C. to 89° C., and it is varied every one degree. However, the value may be set in a broader range, and be varied by smaller or larger increments. In addition, in the above embodiment, the driving current of the compressor is varied by every 0.5A, however, it may be varied by every smaller or larger value.

According to the present invention, the temperature sensor is provided to (mounted on or built in) the power transistor or in the vicinity of the power transistor, and the upper limit value of the driving current of the compressor is reduced (particularly, gradually) when the temperature of the power transistor is higher than a predetermined value. Preferably, the upper limit value of the driving current of the compressor is reduced in accordance with the increase of the temperature detected by the detector. Therefore, although the driving power of the compressor is lowered, excessive heating of the power transistor and other electrical parts in the vicinity of the power transistor can be prevented by the reduction of the driving power, so that stopping of the driving operation of the compressor due to the protection control can be reduced as much as possible. Therefore, unlike the conventional air conditioner in which the compressor is suddenly stopped, the present compressor is prevented from being suddenly stopped, and thus the present invention can provide a relatively comfortable air-conditioning atmosphere to the user.

Further, the upper limit value of the driving current of the compressor is gradually reduced in accordance with the temperature of the temperature sensor. Accordingly, when the temperature detected by the temperature sensor is relatively low, the reduction level of the upper limit value of the driving current is set to a small level. On the other hand, when the temperature detected by the temperature sensor is relatively high, the reduction level of the upper limit value of the driving current is set to a large level. That is, the upper limit value of the driving current of the compressor can be controlled so that the driving operation of the air conditioner is carried out as continuously as possible without being ceased. Therefore, the user hardly feels uncomfortable because the driving operation of the air conditioner is carried out continuously although the driving power is somewhat reduced (the cooling effect is less, as compared with a case where the air conditioning operation is completely ceased due to the stop of the driving operation.

Figure 5:
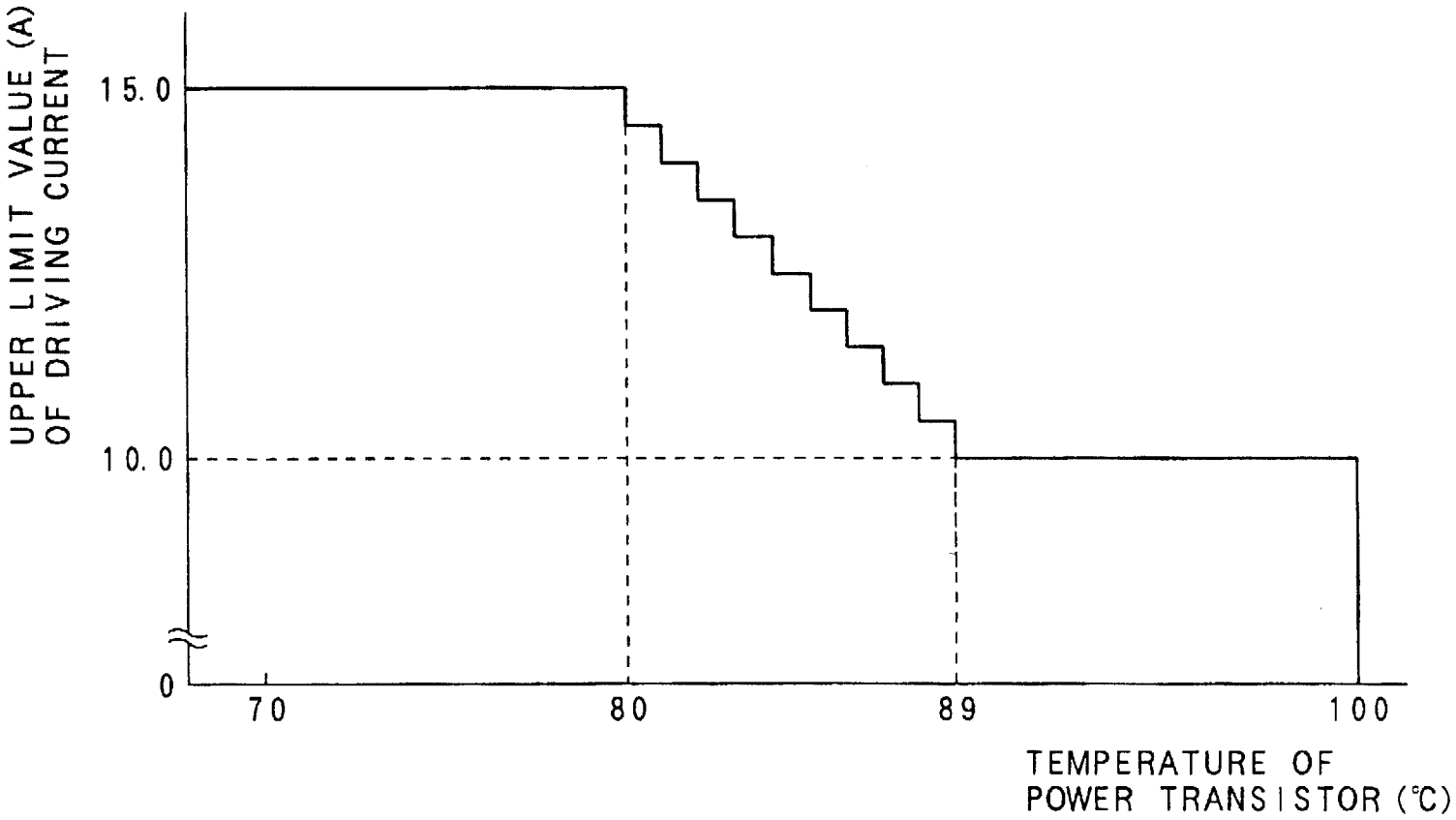
FIG. 5 is a diagram showing a control characteristic of the controller.
Figure 6:
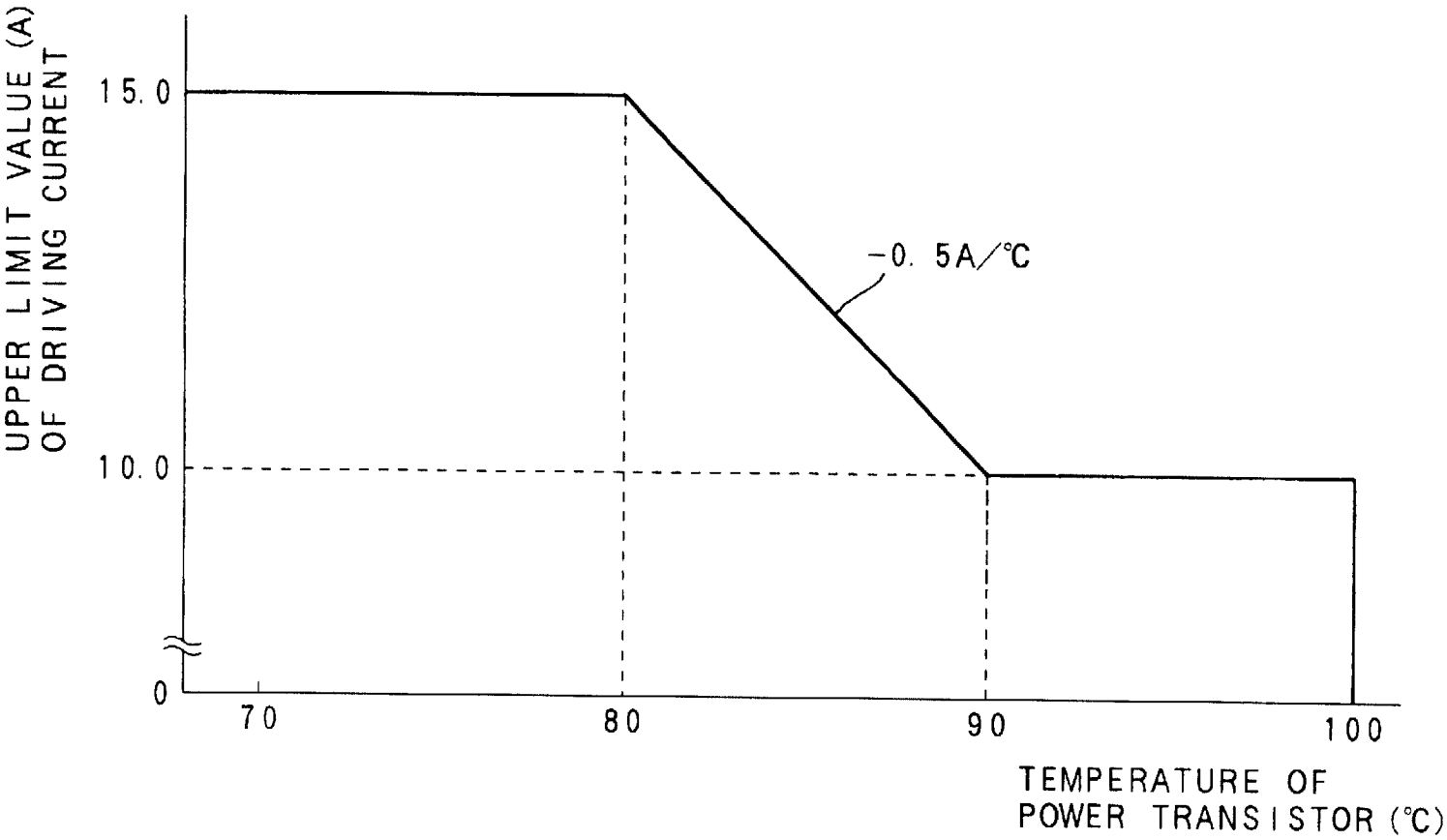
FIG. 6 is a diagram showing a different control characteristic of the controller.

FIG. 6 is a graph showing a different control characteristic of the above-described controller. The difference between the control characteristics of FIGS. 5 and 6 resides in that the control operation of FIG. 6 is carried out linearly, whereas the control operation of FIG. 5 is performed stepwise. When the slope of the current value, where the temperature of the power transistor is equal to 80° to 90° C., is equal to −0.5A/°C., by reducing the driving current of the compressor linearly (in place of stepwise), the driving power of the compressor can be reduced more smoothly when it is driven at the maximum power. Thus, the situation is avoided where the comfortable air conditioning level is suddenly lowered due to rapid reduction in cooling power.

In the above-described embodiment, the power transistor is provided with the temperature sensor. The temperature sensor may be provided to another electrical part which is sensitive to heat (for example, the semiconductor parts, the ICs 53, 54, the electrolytic transistor 50, etc. on the board 49) to reduce the upper limit value of the driving current of the compressor.

Further, the temperature sensor may be disposed in the vicinity of the power transistor, or in a cooler to indirectly detect the temperature of the power transistor. In this case, the correlation between the temperature of the cooler and the temperature of the power transistor must be examined in advance to preset a predetermined value of the cooler.

In addition, a power transistor in which a temperature sensor is beforehand built may be manufactured and used.

According to the present invention, a temperature sensor is provided to or in the vicinity of a heat-sensitive electrical part such as a power transistor or the like, and when the temperature detected by the temperature sensor is high, the upper limit value of the driving current of the compressor is reduced. Therefore, although the driving power of the air conditioner is lowered, the heating of the electrical parts such as the power transistor, etc., can be reduced due to the reduction of the driving power, so that sudden stopping of the driving operation of the air conditioner by the protection control is avoided as much as possible. Accordingly, as compared with the conventional air conditioner in which the driving of the compressor is relatively often stopped by the protection control, the present invention can provide an air condition which make users less uncomfortable.

Further, the present invention can provide an air conditioner which can prevent the heat-sensitive electrical parts such as the power transistor, etc., from being damaged and make users less uncomfortable as compared with the conventional air conditioner in which the driving of the compressor is relatively often stopped by the protection control.

Particularly, according to the present invention, the upper limit value of the driving current of the compressor is reduced in accordance with the temperature detected by the temperature sensor. Therefore, when the temperature detected by the temperature sensor is relatively low, the reduction level of the upper limit value of the driving current is set to a smaller value. On the other hand, when the temperature detected by the temperature sensor is relatively high, the reduction level of the upper limit value of the driving current is set to a larger value. That is, the upper limit value of the driving current of the compressor is gradually controlled so that the driving of the compressor is carried out as continuously as possible without being ceased. Therefore, there is provided an air conditioner which prevents reduction in cooling power from occurring suddenly and thus makes users uncomfortable as little as possible.

What is claimed is:

1. An air conditioner having a compressor for air conditioning operation, and an electrical circuit containing a controller equipped with heat-producing electrical parts for controlling a driving current of the compressor, including a temperature sensor which is provided adjacent at least one heat-sensitive electrical part of the electrical parts for detecting a temperature of the heat-sensitive electrical part; and means for reducing an upper-limit value of the driving current of said compressor when the temperature detected by said temperature sensor is higher than a predetermined value, the upper-limit value being adjusted to one of a plurality of predetermined values based on the temperature detected.

2. The air conditioner as claimed in claim 1, wherein said temperature sensor is mounted on or is built-in to the heat-sensitive electrical part.

3. The air conditioner as claimed in claim 1, wherein said heat-sensitive electrical part comprises a power transistor.

4. The air conditioner as claimed in claim 1, wherein said means reduces the upper-limit value of the driving current of said compressor stepwise in accordance with an increase of the temperature detected by said temperature sensor.

5. The air conditioner as claimed in claim 1, wherein said means reduces the upper-limit value of the driving current of said compressor linearly in accordance with the increase of the temperature detected by said temperature sensor.

6. The air conditioner as claimed in claim 1, wherein said means controls the operating frequency of said compressor to reduce the driving current of said compressor.

7. The air conditioner as claimed in claim 1, wherein said temperature sensor comprises a thermistor.

8. A control system for an air conditioner having a compressor for air conditioning operation, the control system comprising:

a temperature sensor located adjacent to at least one heat-sensitive electrical part for detecting a temperature of the heat-sensitive electrical part and for generating a temperature signal representative of the temperature sensed; and an electrical circuit containing a controller equipped with heat-producing and heat-sensitive electrical parts for controlling a driving current of the compressor, the controller being connected to the temperature sensor for receiving the temperature signal, said controller setting an upper-limit value of the driving current of the compressor, the controller being responsive to receipt of a temperature signal from the temperature sensor corresponding to a temperature above a predetermined level to reduce the upper-limit value to a predetermined value corresponding to the temperature sensed.

9. The air conditioner of claim 8 wherein the temperature sensor is mounted on or built-in to the heat-sensitive electrical part.

10. The air conditioner of claim 8 wherein the heat-sensitive electrical part comprises a power transistor.

11. The air conditioner of claim 8 wherein the controller reduces the upper-limit value of the driving current stepwise corresponding with an increase of the temperature detected by the temperature sensor.

12. The air conditioner of claim 8 wherein the controller reduces the upper-limit value of the driving current linearly corresponding with an increase of the temperature detected by the temperature sensor.

13. The air conditioner of claim 8 wherein the controller controls the frequency of the compressor to reduce the driving current of the compressor.

14. The air conditioner of claim 8 wherein the temperature sensor comprises a thermistor.

* * * * *